US006527068B1

(12) United States Patent
Singh et al.

(10) Patent No.: US 6,527,068 B1
(45) Date of Patent: Mar. 4, 2003

(54) ROLLER CONE DRILL BIT HAVING NON-AXISYMMETRIC CUTTING ELEMENTS ORIENTED TO OPTIMIZE DRILLING PERFORMANCE

(75) Inventors: Amardeep Singh, Houston, TX (US); Sujian Huang, The Woodlands, TX (US); Scott McDonough, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/640,219

(22) Filed: Aug. 16, 2000

(51) Int. Cl.[7] ..... E21B 10/08

(52) U.S. Cl. ..... 175/431; 175/331; 175/376; 76/108.2

(58) Field of Search ..... 175/57, 331, 374, 175/376, 377, 378, 431; 76/158.2, 158.4

(56) References Cited

U.S. PATENT DOCUMENTS

| | | | | |
|---|---|---|---|---|
| 2,990,025 A | | 6/1961 | Talbert et al. | 175/375 |
| 3,385,385 A | | 5/1968 | Kucera et al. | 175/374 |
| 4,187,922 A | | 2/1980 | Phelps | 175/374 |
| 4,393,948 A | | 7/1983 | Fernandez | 175/374 |
| 5,197,555 A | | 3/1993 | Estes | 175/431 |
| 5,730,234 A | | 3/1998 | Putot | 175/50 |
| 6,095,262 A | * | 8/2000 | Chen | 175/57 |
| 6,161,634 A | * | 12/2000 | Minikus et al. | 175/331 |
| 6,213,225 B1 | | 4/2001 | Chen | 175/57 |
| 6,401,839 B1 | | 6/2002 | Chen | 175/57 |
| 6,412,577 B1 | | 7/2002 | Chen | 175/57 |

FOREIGN PATENT DOCUMENTS

| | | |
|---|---|---|
| GB | 2 328 966 A | 3/1999 |
| GB | 2 360 304 A | 9/2001 |
| WO | WO 00/12859 | 3/2000 |
| WO | WO 00/12860 | 3/2000 |

OTHER PUBLICATIONS

European Search Report Dated Dec. 11, 2001, 5 pages.
Ma Dekun et al., "The Operational Mechanics of The Rock Bit", Petroleum Industry Press, 1996, pp. 1–243.
Society of Petroleum Engineers Paper No. 29922, "The Computer Simulation of the Interaction Between Roller Bit and Rock", Dekun Ma, et al, presented Nov. 14–17, 1995, 9 pages.
Society of Petroleum Engineers Paper No. 56439, "Field Investigation of the Effects of Stick–Slip, Lateral, and Whirl Vibrations on Roller Cone Bit Performance", S. L. Chen et al, presented Oct. 3–6, 1999, 10 pages.
Society of Petroleum Engineers Paper No. 71053, "Development and Application of a New Roller Cone Bit with Optimized Tooth Orientation", S. L. Chen et al., presented May 21–23, 2001, 15 pages.
Society of Petroleum Engineers Paper No. 71393, "Development and Field Applications of Roller Cone Bits with Balanced Cutting Structure", S. L. Chen et al., presented Sep. 30 –Oct. 3, 2001, 11 pages.

* cited by examiner

*Primary Examiner*—David Bagnell
*Assistant Examiner*—Jennifer R. Dougherty
(74) *Attorney, Agent, or Firm*—Rosenthal & Osha L.L.P.

(57) ABSTRACT

A method for optimizing drilling performance of a roller cone drill bit is disclosed. The method includes simulating drilling with the bit in a selected earth formation to determine at least one drilling performance parameter. The orientation of at least one non-axisymmetric cutting element on the bit is adjusted and the simulating the drilling and determining the at least one performance parameter are repeated. The adjusting and simulating the drilling are repeated until the at least one performance parameter is determined to be at an optimum value. In one embodiment, the performance parameter includes rate of penetration.

24 Claims, 3 Drawing Sheets

ROLLER CONE DRILL BIT HAVING NON-AXISYMMETRIC CUTTING ELEMENTS ORIENTED TO OPTIMIZE DRILLING PERFORMANCE

BACKGROUND OF THE INVENTION

1. Field of the Invention

The invention relates generally to the field of drill bits used to drill earth formations. More specifically, the invention relates to methods for designing, and to designs, for drill bits having improved drilling performance.

2. Description of the Related Art

Roller cone drill bits used to drill wellbores through earth formations generally include a plurality of roller cones rotatably mounted to a bit body. The bit body is turned by a drilling apparatus (drilling rig) while axial force is applied to the bit to drill through the earth formations. The roller cones include a plurality of cutting elements disposed at selected locations thereon. The types, sizes and shapes of the cutting elements are generally selected to optimize drilling performance of the drill bit in the particular earth formations through which the formation is to be drilled.

The cutting elements may be formed from the same piece of metal as each of the roller cones, these being so-called "milled tooth" bits. Other types of cutting elements consist of various forms of "inserts" (separate bodies formed from selected materials) which can be affixed to the roller cones in a number of different ways.

Some types of cutting elements, both milled tooth and insert type, have cutting edges ("crests") which are not symmetric with respect to an axis within the body of the cutting element. These are called non-axisymmetric cutting elements. Some types of roller cone drill bits have non-axisymmetric cutting elements oriented so that the crests are oriented in a selected direction. The purpose of such crest orientation is to improve the drilling performance of the roller cone bit.

One such method for improving drill bit performance by orienting cutting element crests along a particular direction is described in published patent application PCT/US99/19992 filed by S. Chen. The method disclosed in this application generally includes determining an expected trajectory of the cutting elements as they come into contact with the earth formation. The expected trajectory is determined by estimating a rotation ratio of the roller cones, this ratio being the cone rotation speed with respect to the bit rotation speed. The crests of the cutting elements are then oriented to be substantially perpendicular to, or along, the expected trajectory. Whether the crests are oriented perpendicular or along the expected trajectory depends on the type of earth formation being drilled.

Yet another method for orienting the crests of the cutting elements on a roller cone bit is described in U.S. Pat. No. 5,197,555 issued to Estes. As explained in the Estes '555 patent, the crests of the cutting elements are oriented within angle ranges of 30 to 60 degrees (or 300 to 330 degrees) from the axis of rotation of the cone.

It is desirable to provide a drill bit wherein non-axisymmetric cutting elements are oriented to optimize a rate at which the drill bit cuts through earth formations.

SUMMARY OF THE INVENTION

One aspect of the invention is a roller cone drill bit having roller cones rotatably attached to a bit body. Each of the cones includes a plurality of cutting elements, at least one of the cutting elements being non-axisymmetric and oriented so that a value of at least one drilling performance parameter is optimized. In one embodiment, the at least one parameter include rate of penetration of the drill bit.

In one embodiment, the crest of the at least one cutting element is oriented at an angle of about 10 to 25 degrees from the direction of movement of the cutting element as it contacts the earth formation when the cutting element is disposed in a position outboard of the drive row location on the cone. In another embodiment, the angle is about 350 to 335 degrees when the cutting element is disposed in a position inboard of the drive row location.

Another aspect of the invention is a method for designing a roller cone drill bit including simulating the bit drilling earth formations. The drill bit includes roller cones rotatably attached to a bit body. Each of the cones includes a plurality of cutting elements, at least one of the cutting elements being non-axisymmetric. In the method, an orientation of the cutting element is adjusted, and the drilling is again simulated. The adjustment and simulation are repeated until the value of at least one drilling performance parameter is optimized. In one embodiment, the at least one performance parameter includes the rate of penetration of the drill bit.

Other aspects and advantages of the invention will be apparent from the description which follows.

DETAILED DESCRIPTION OF THE INVENTION

Figure 1:
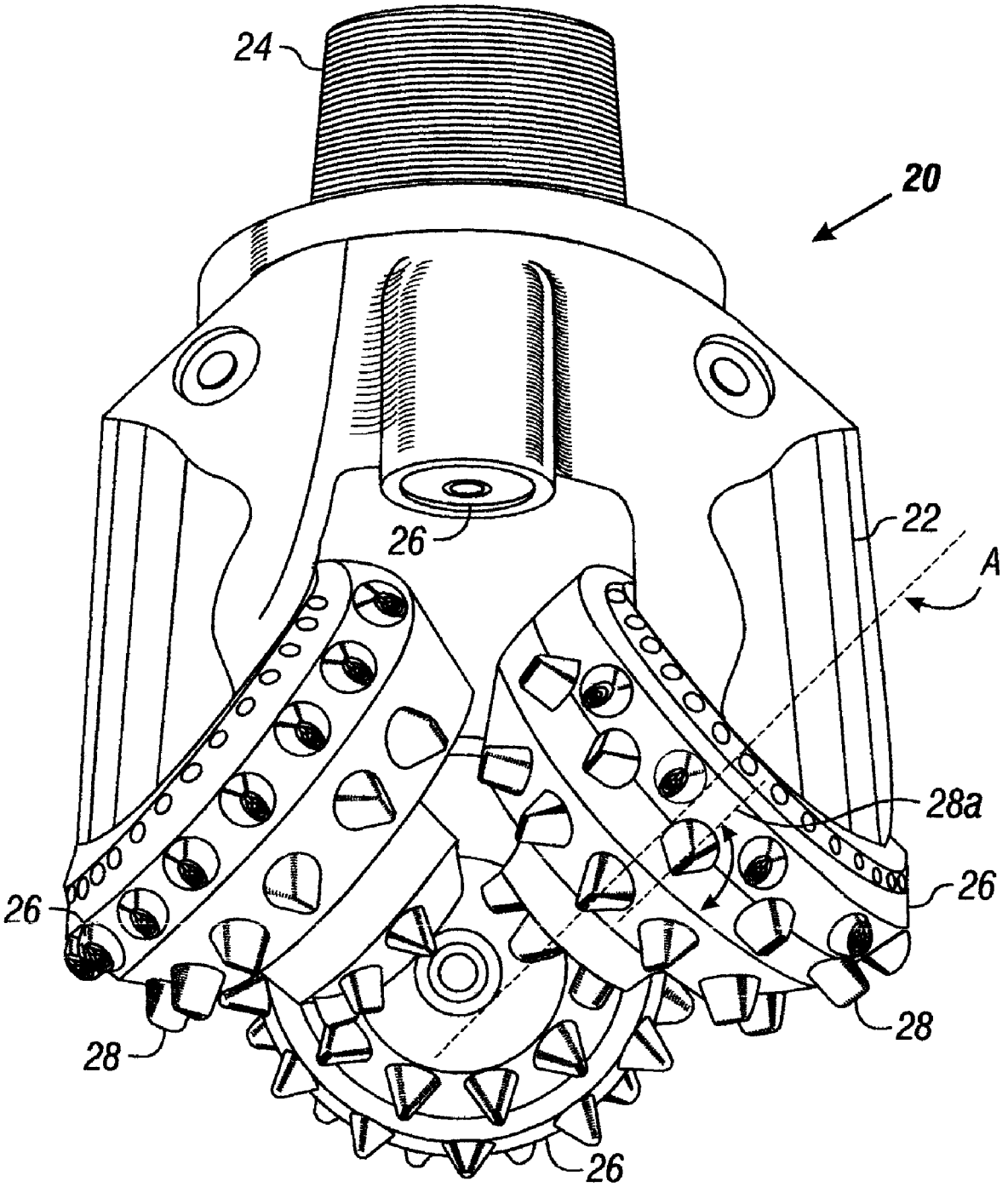
FIG. 1 (Prior Art)
FIG. 1 shows one example of a prior art roller cone drill bit having non-axisymmetric cutting elements.

Referring to FIG. 1, a typical prior art roller cone drill bit 20 includes a bit body 22 having an externally threaded connection at one end 24, and a plurality of roller cones 26 (usually three as shown) attached to the other end of the bit body 22 and able to rotate with respect to the bit body 22. Attached to the cones 26 of the bit 20 are a plurality of cutting elements 28 typically arranged in rows about the surface of the cones 26. The cutting elements 28 can be any type known in the art, including tungsten carbide inserts, polycrystalline diamond compacts, or milled steel teeth. The cutting elements shown in FIG. 1 at 28 are non-axismmetric, meaning that the crest 28A of the cutting element is not symmetric with respect to an axis (not shown) of the cutting element 28. Typically, the crest 28A of a non-axisymmetric cutting element such as shown at 28 will define a long dimension, shown along line L. An orientation of the long dimension L is generally defined as an angle subtended between the direction of the long dimension L and a selected reference. In this example the reference is the rotational axis of the cone, shown at A. Any other suitable reference can be used to define the orientation of the cutting element. The non-axisymmetric cutting elements 28 on the bit 20 shown in FIG. 1 are arranged so that the long dimension L is substantially parallel (at zero degrees subtended angle) with respect to the axis rotation A.

Figure 4:
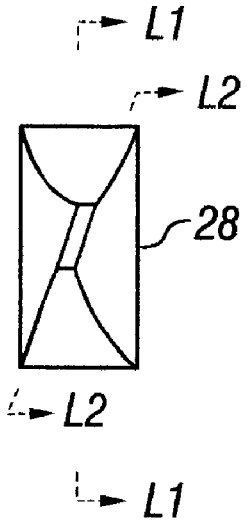
FIG. 4 shows one embodiment of a cutting element which has more than one direction of a long dimension.

It should be noted that the long dimension L for the crest 28A shown in FIG. 1 is substantially parallel to the crest 28A because the crest 28A is linear. Other shapes of crest are known in the art which will have different definitions of the long dimension. For example, crescent shaped crests on some cutting elements may have the long dimension defined as along a line connecting the endpoints of the crescent. Referring briefly to FIG. 4, for example, a special type of cutting element 28B has a long dimension L2 across its crest which as shown in this example is oriented differently than the long dimension L1 of the base of the cutting element 28B. For the description of the invention which follows, the orientation of the crest of such cutting elements will be determined by the direction of L2. As will be further explained, the individual orientation of both L2 and of L1 can be optimized to provide improved drilling performance.

Referring back to FIG. 1, although the bit 20 has been shown wherein substantially all the cutting elements 28 include the long dimension L, it is within the scope of this invention if only one such cutting element, or any other number of such cutting elements, is non-axisymmetric and includes long dimension L. The rest of the cutting elements may be axisymmetric. Therefore, the number of non-axisymmetric cutting elements is not intended to limit the invention.

It has been determined that the orientation of the long dimension L with respect to the axis of the cone A has an effect on drilling performance of the bit 20. In one aspect of the invention, drilling with the bit 20 through a selected earth formation is simulated. The simulation typically includes determination of a rate at which the bit penetrates through the selected earth formation (ROP), among other performance measures. In this aspect of the invention, the angle of the long dimension L with respect to the selected reference is adjusted, the drilling simulation is repeated, and the performance of the bit is again determined. The adjustment to the angle and simulation of drilling are repeated until the drilling performance is optimized. In one embodiment of the invention, optimization is determined when the rate of penetration (ROP) is determined to be maximum.

One such method for simulating the drilling of a roller cone drill bit such as shown in FIG. 1 is described in U.S. patent application Ser. No. 09/524,088 filed on Mar. 13, 2000, and assigned to the assignee of this invention. The method of the '088 patent application is hereby incorporated by reference. The method for simulating the drilling performance of a roller cone bit drilling an earth formation may be used to optimize the design of roller cone drill bits, and to optimize the drilling performance of a roller cone bit. The method includes selecting bit design parameters, selecting drilling parameters, and selecting an earth formation to be drilled. The bit design parameters generally include at least the shape of the Cutting elements on the drill bit. The method further includes calculating, from the bit design parameters, drilling parameters and earth formation, the parameters of a crater formed when one of the cutting elements contacts the earth formation. The method further includes calculating a bottomhole geometry, wherein the crater is removed from a bottomhole surface. The method also includes incrementally rotating the bit and repeating the calculating of crater parameters and bottomhole geometry based on calculated roller cone rotation speed and geometrical location with respect to rotation of said roller cone drill bit about its axis.

In the present embodiment, the simulation according to the previously described program is performed. At least one drilling performance parameter, which can include the rate of penetration, is determined as a result of the simulation. The angle of the long dimension L of the at least one non-axisymmetric cutting element is adjusted. The simulation is repeated, typically including maintaining the values of all the other drilling control and drill bit design parameters, and the value of the at least one drilling performance parameter is again determined. This process is repeated until the value of the drilling performance parameter is optimized. In one example, as previously explained, the drilling performance parameter is optimized when rate of penetration is determined to be at a maximum.

For the special cutting element 28B shown in FIG. 4, the orientation of the crest long dimension L2 and the orientation of the base long dimension L1 can both be adjusted, the simulation repeated, and the results compared until the value of the at least one drilling performance parameter is optimized. It is believed that in some drill bits, the direction of the velocity vector may be different at the crest of the cutting elements than at the base of the cutting elements. Specially shaped cutting elements such as shown at 28B in FIG. 4 provide the bit designer with the ability to optimize the orientation of the long dimension at both the crest and at the base of the cutting elements to further improve drilling performance. As for the other embodiments of a bit according to the various aspects of the invention, the number of such special cutting elements as shown in FIG. 4 is not meant to limit the scope of the invention.

Figure 2:
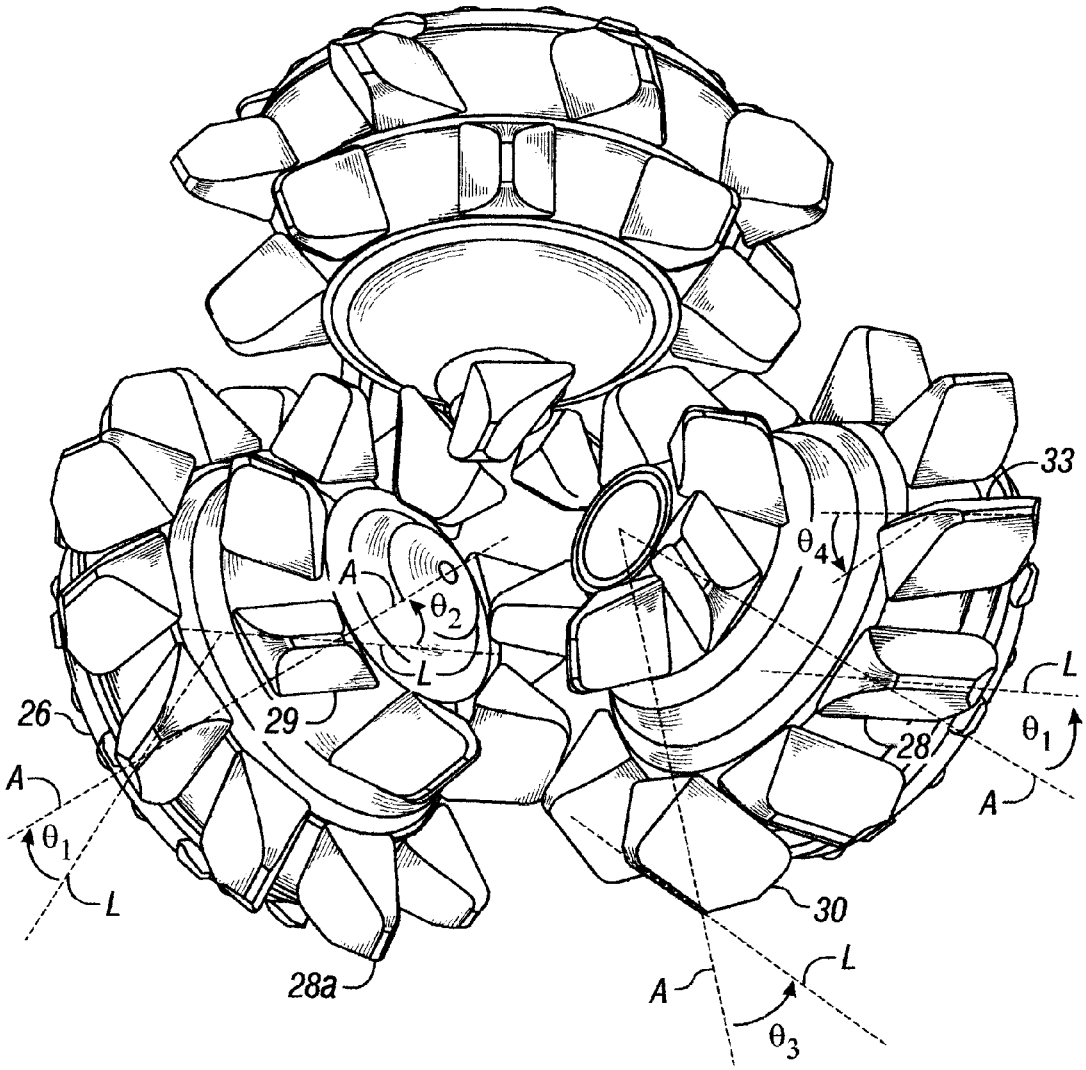
FIG. 2 shows a bottom view of one example of a roller cone bit having cutting elements oriented according to the invention.

Another aspect of non-axisymmetric cutting elements is that some types of such cutting elements may not be symmetric with respect to a bisecting plane. Other types of such cutting elements may be symmetric with respect to a bisecting plane. Referring briefly to FIG. 1, typical prior art cutting elements such as 28A which are not axisymmetric nonetheless have a bisecting plane about which the cutting element is symmetric. In the prior art, such cutting elements 28A are oriented such that the bisecting plane is substantially perpendicular to the surface of the roller cone. Another aspect of the invention is that in addition to orienting the cutting element crest at a selected angle with respect to the cone axis, the bisecting plane is oriented at a selected angle with respect to the surface of the cone. An example of this orientation is shown in FIG. 2, where bisecting plane P subtends an angle $\theta_4$ with respect to perpendicular to the surface of the cone 26. As with other aspects of the invention, the orientation of the subtended angle $\theta_4$ is preferably determined by selecting an initial value of the subtended angle, simulating performance of the bit, adjusting the angle, and repeating the simulating performance until an optimal value of the at least one drilling performance parameter is determined.

Referring to FIG. 2, through drilling simulation according to the method described in the '088 patent application, it has been determined that drilling performance of a certain type of roller cone bit known as a tungsten carbine insert (TCI) bit having "chisel" shaped inserts, is optimal when the angle, shown as $\theta_1$, of the long dimension L is in a range of about 10 to about 25 degrees with respect to the axis A, when the cutting element 28 is disposed in a position on the cone radially outboard (away from the center of the cone) of the radial position of a "drive row" on the cone. If the cutting element, for example, as shown at 29, is disposed in a row radially interior to the drive row position, it has been determined that drilling performance is improved when the angle, shown in FIG. 2 as $\theta_2$, is within a range of about 350 to 335 degrees. The definition of the size of the angle used herein is that the angle increases in a direction of the "leading" edge (toward the direction of rotation of the cone).

It has been determined through simulation of drilling with the bit that a more preferred value for the angle $\theta_1$ is about 25 degrees, and that a more preferred value for angle $\theta_2$ is about 335 degrees.

In the event that the cutting element is radially positioned at the drive row location, the angle may be either approximately 10 to 25, or 350 to 335 degrees, (or more preferably 25 or 335 degrees) depending on which value of the angle provides a more optimized value of the drilling performance parameter, such as higher rate of penetration.

Figure 3:
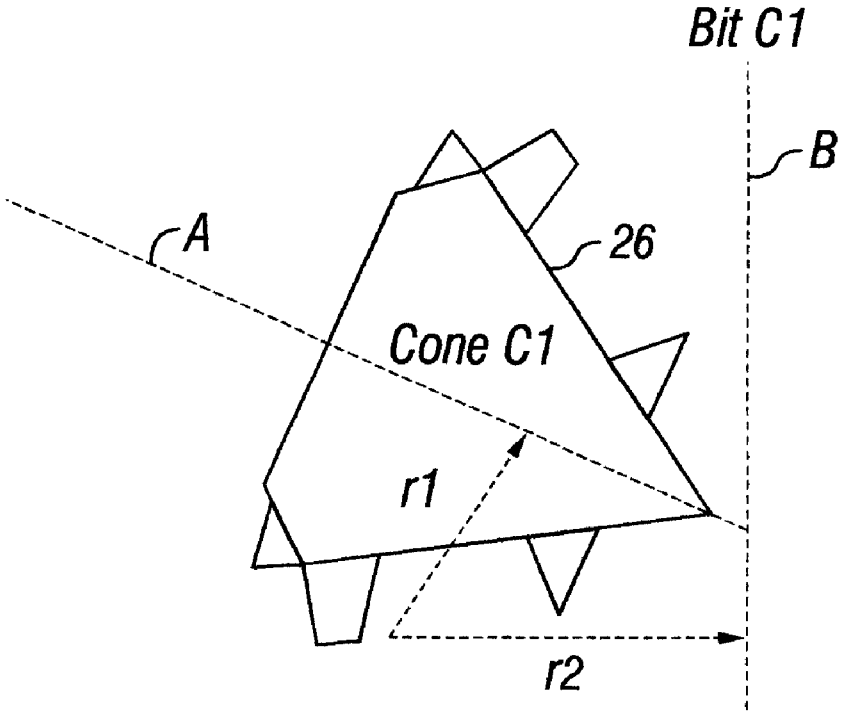
FIG. 3 shows one example of how to approximate a location of a drive row on a cone.

One method for estimating the position of the drive row is illustrated in FIG. 3. The rotation ratio of each of the cones 26 can be determined, for example, using force calculations such as described in the '088 patent application referred to earlier, or by simulating the drilling of the bit as in the '088 patent application. Having determined or otherwise estimated the rotation ratio of the cone 26, a ratio of drive row distance $r_2$ from the axis of the bit B with respect to effective cone radius $r_1$ will be approximately related to the position of the drive row. The drive row position for purposes of this invention will be located approximately at the position along the cone axis A where the ratio $r_2/r_1$ is approximately the same as the rotation ratio of the cone 26. In any particular bit design, there may or may not be a row of cutting elements disposed at the drive row location. The angle for orienting the at least one cutting element can be selected, as previously explained, by considering the location of the at least one cutting element with respect to the drive row location estimated according to the previously described method.

Referring again to FIG. 3, a particular feature of the invention is shown which has as its purpose further improvement of drilling performance. At least one of the cutting elements 30, in a row in which all the other cutting elements are oriented at the preferred angle $\theta_1$, preferably is oriented at a different angle $\theta_3$ so that the row of cutting elements will resist "tracking". The magnitude of the difference in the angles is not important, but only need be selected to avoid tracking. In particular, whether the selected difference in angle between the at least one cutting element and the other cutting elements on the same row is enough to avoid tracking can be determined, among other methods, by using the drilling simulation technique described in the '088 patent application referred to earlier.

This feature of the invention can work with other embodiments of a drill bit. For example, substantially all of the cutting elements on the bit may have long dimension L parallel to the respective axis A of the cone on which each cutting element is disposed. At least one cutting element on any one row of cutting elements on the bit may be disposed so that its long dimension L subtends an angle other than parallel to the cone axis. In another example, at least one cutting element on each row on one cone can be disposed so that its long dimension is other than parallel to the respective cone axis. In yet another example, at least one cutting element on each cone, or alternatively, at least one cutting element on each row of each cone can be oriented so that its long dimension is other than parallel to the cone axis. In each of the foregoing examples, orienting the at least one cutting element so that its long dimension other than parallel to the cone, when all the other cutting elements in the same row are parallel to their respective cone axis is intended to reduce tracking. This aspect of the invention will also work where the other ones of the cutting elements on the same row are not parallel to the cone axis but are disposed at some selected angle (such as the previously described preferred angle). As long as at least one cutting element is disposed at a different angle than all the other cutting elements on one row of cutting elements on the bit, such configuration is within the contemplation of this aspect of the invention. In another example, each row of cutting elements on each of the cones includes at least one cutting element disposed at an angle different from all the other cutting elements on the row to avoid tracking.

The invention has been described with respect to particular embodiments.

It will be apparent to those skilled in the art that other embodiments of the invention can be devised which do not depart from the spirit of the invention as disclosed herein. Accordingly, the invention shall be limited in scope only by the attached claims.

What is claimed is:

1. A method for optimizing drilling performance of a roller cone drill bit, comprising:

simulating drilling with the bit in a selected earth formation to determine at least one drilling performance parameter;

adjusting, an orientation of at least one non-axisymmetric cutting element on the bit;

repeating the simulating the drilling and determining the at least one performance parameter; and repeating the adjusting and simulating the drilling until the at least one performance parameter is determined to be at an optimum value.

2. The method as defined in claim 1 wherein the at least one performance parameter comprises a rate of penetration.

3. The method as defined in claim 2 wherein the optimum value is determined when the rate of penetration is at a maximum value.

4. The method as defined in claim 3 wherein the optimum value determined when the orientation is in a range of about 10 to 25 degrees when the at least one cutting element is disposed outboard of a drive row location on a cone.

5. The method as defined in claim 3 wherein the optimum value is determined when the orientation is about 25 degrees when the at least one cutting element is disposed outboard of a drive row location on a cone.

6. The method as defined in claim 3 wherein the optimum value is determined when the orientation is in a range of about 350 to 335 degrees when the at least one cutting element is disposed inboard of a drive row location on a cone.

7. The method as defined in claim 3 wherein the optimum value determined when the orientation is about 335 degrees when the at least one cutting element is disposed inboard of a drive row location on a cone.

8. The method as defined in claim 1 wherein an orientation of a crest of the at least one non-axisymmetric cutting element is adjusted separately from an orientation of a base of the at least one non-axisymmetric cutting element to optimize the value of the at least one drilling performance parameter.

9. The method as defined in claim 1 further comprising:

adjusting an angle of a bisecting plane of the at least one non-axisymmetric cutting element with respect to a surface of a roller cone on which the at least one non-axisymmetric cutting element is disposed;

repeating the simulating and determining; and repeating the adjusting the bisecting plane angle, simulating and determining until the optimal value of the at least one drilling performance parameter is determined to be at the optimal value.

10. A roller cone drill bit, comprising:

a plurality of roller cones, each rotatably mounted on a bit body;

a plurality of cutting elements on each of the cones, at least one of the cutting elements being non-axisymmetric; and wherein an angle subtended between a long dimension of the at least one non-axisymmetric cutting element and an axis of rotation of the cone on which the at least one cutting element is disposed is selected to optimize a value of at least one drilling performance parameter.

11. The roller cone drill bit as defined in claim 10 wherein the at least one drilling performance parameter comprises rate of penetration of the bit.

12. The roller cone drill bit as defined in claim 10 wherein the angle is approximately 10 to 25 degrees when the at least one cutting element is disposed outboard of a drive row location on the cone.

13. The roller cone drill bit as defined in claim 10 wherein the angle is approximately 25 degrees when the at least one cutting element is disposed outboard of a drive row location on the cone.

14. The roller cone drill bit as defined in claim 10 wherein the angle is approximately 350 to 335 degrees when the at least one cutting element is disposed inboard of a drive row location on the cone.

15. The roller cone drill bit as defined in claim 10 wherein the angle is approximately 335 degrees when the at least one cutting element is disposed inboard of a drive row location on the cone.

16. The roller cone drill bit as defined in claim 10 wherein the angle is the one of approximately 25 degrees and approximately 335 degrees which provides a higher rate of penetration, when the at least one cutting element is disposed on a drive row location on the cone.

17. The roller cone drill bit as defined in claim 10 wherein the cutting elements comprise milled steel teeth.

18. The roller cone drill bit as defined in claim 10 wherein the cutting elements comprise tungsten carbide inserts.

19. The roller cone drill bit as defined in claim 10 wherein the cutting elements comprise polycrystalline diamond compacts.

20. The roller cone drill bit as defined in claim 10 wherein at least one cutting element in a row having cutting elements oriented at the subtended angle is disposed at a different angle whereby the drill bit substantially avoids tracking.

21. The roller cone drill bit as defined in claim 10 wherein an angle subtended between a long dimension of a crest of the at least one non-axisymmetric cutting element and an axis of rotation of the cone on which the at least one cutting element is disposed, and an angle subtended between a long dimension of the base of the non-axisymmetric cutting element and the axis of the cone are both selected to optimize a value of the at least one drilling performance parameter.

22. The roller cone drill bit as defined in claim 21 wherein the at least one drilling performance parameter comprises rate of penetration of the bit.

23. The roller cone as defined in claim 10 wherein an angle subtended between a bisecting plane of the at least one non-axisymmetric cutting element and a surface of the cone on which the at least one non-axisymmetric cutting element is disposed is selected to optimize the value of the at least one drilling performance parameter.

24. The roller cone drill bit as defined in claim 23 wherein the at least one drilling performance parameter comprises rate of penetration of the bit.

* * * * *